United States Patent [19]

Watson

[11] 3,952,134

[45] Apr. 20, 1976

[54] CONTINUOUS FILAMENT PRODUCT

[75] Inventor: George A. Watson, Davidson, N.C.

[73] Assignee: Celanese Corporation, New York, N.Y.

[22] Filed: June 15, 1971

[21] Appl. No.: 153,420

Related U.S. Application Data

[63] Continuation of Ser. No. 20,444, March 23, 1973, abandoned, which is a continuation-in-part of Ser. No. 382,018, July 13, 1964, Pat. No. 3,328,850.

[52] U.S. Cl. ..... 428/391; 19/65 T; 28/75 R

[51] Int. Cl.[2] ..... B44D 1/22; B44D 5/00; D06M 15/66

[58] Field of Search ..... 161/173, 175, 176, 141, 161/143; 19/65 T, 66 T; 28/75 R; 117/161 ZA, 139.5 A, 139.5 CQ, 138.8 A, 138.8 B, 138.8 F, 138.8 E; 8/115.6; 252/8.6

[56] References Cited

UNITED STATES PATENTS

| | | | |
|---|---|---|---|
| 2,702,276 | 2/1955 | Green | 252/8.6 |
| 2,794,480 | 6/1957 | Crawford et al. | 156/441 |
| 3,126,095 | 3/1964 | Caines et al. | 161/173 |
| 3,156,016 | 11/1964 | Dunlap et al. | 156/166 |
| 3,226,773 | 1/1966 | Paliyenko | 28/75 |
| 3,251,794 | 5/1966 | Paliyenko et al. | 117/161 ZA |
| 3,271,189 | 9/1966 | Hoffmann | 117/161 ZA |
| 3,488,217 | 1/1970 | Ryan | 117/138.8 A |
| 3,499,810 | 3/1970 | Wagle | 117/138.8 A |
| 3,639,154 | 2/1972 | Sawa et al. | 117/138.8 A |

*Primary Examiner*—Caleb Weston
*Attorney, Agent, or Firm*—Herbert M. Adrian, Jr.

[57] ABSTRACT

A crimped deregistered tow of continuous filaments wherein the filaments are coated with a silicone finish which is substantially free of antistatic agents and the products produced therefrom such as pillow, sleeping bags, furniture cushions and the like.

15 Claims, No Drawings

CONTINUOUS FILAMENT PRODUCT

BACKGROUND OF THE INVENTION

This application is a continuation of Ser. No. 20,444 filed MAR. 23, 1973, now abandoned, which in turn is a continuation-in-part of Ser. No. 382,018 filed July 13, 1964, now U.S. Letters Pat. No. 3,328,850.

This invention relates to products made by the opening of crimped strands of continuous filamentary materials and more particularly to the high bulk products made by the opening of crimped strands of continuous filaments treated with a silicone finish which is substantially free of an antistatic agent.

The deregistration of crimped continuous filaments, often referred to as the opening of crimped strands, is known in the art. Examples of processes of this type are found in U.S. Pat. No. 3,032,829 and U.S. Pat. No. 3,156,016. The resulting opened tow, which is made up of a large number of continuous filaments with deregistered crimps are suitable for the production of numerous diverse items.

Previously, the deregistration of the crimped tow was accomplished after treating the two with an antistatic agent as is normally utilized in the production of staple or other processing methods involving continuous crimped tow; the agent was normally applied either with the lubricant following extrusion or with a silicone. The antistatic agent was considered to be a necessity to enable the tow or staple fibers cut therefrom to be handled in processing equipment without the normally considered detrimental effect of static electricity, viz, clinging to machine surfaces, mutual repulsion, etc. Accordingly, in the parent application noted above, of which this is a continuation-in-part, a process was disclosed whereby in the deregistration and subsequent spreading of continuous filaments using a patterned roll, the processing could be greatly enhanced by increasing the static electrical charge in the tow of continuous filaments and thereby enhance the spreading of the deregistered tow in subsequent spreading steps.

It is an object of the present invention to provide a deregistered continuous filament tow product of enhanced physical properties, particularly in suppleness, bulkiness and like features particularly desirable for cushioning products having goose down-like properties. It is another object of the present invention to provide end products having the improved desirable physical properties of increased bulkiness, suppleness and the like which are permenently incorporated into the product. These and other objects will become apparent to those skilled in the art from the description of the invention which follows.

SUMMARY OF THE INVENTION

In accordance with the invention, a crimped deregistered tow of continuous filaments is provided wherein said filaments are coated with a silicone finish and are substantially free of antistatic agents. More particularly, the invention is directed to the described tows which, after being deregistered, are subjected to at least one spreading step. In addition, the present invention provides a means for obtaining improved cushioning and insulating products such as pillows, mattresses, sleeping bags, furniture cushions, upholstery, mattress pads, thermal underwear, quilted outerwear, needled papermaker's felt and the like of increased bulkiness.

In the present invention, a previous disadvantageous characteristic of continuous filaments of synthetic polymers has been turned into an advantage to greatly enhance the characteristics of the end product. Although the cooperative action of the lack of an antistatic agent and the presence of the silicone finish is not completely understood, it is believed that the use of the silicone finish imparts a slippery surface to the individual fibers while the absence of an antistatic agent due to failure to provide it initially or, if provided, due to its subsequent removal, results in the build up of higher electrical charges in the processing fibers as they rub over the equipment which charges, being similar, tend mutually to repel the individual fibers or filaments from one another. The slippery silicone surface finish permits the movement of the fibers away from each other under the small electrical repulsive forces, thereby aiding in the spreading action being carried out on the tow. Surprisingly, the spreading action is effected multidirectionally thereby greatly increasing the bulkiness of the tow passed through the patterned roll and subsequent spreading steps.

Preferably, the silicone resin is applied so as to form a tough, flexible hydrophobic film of silicone resin around each individual fiber or filament. The silicone is desirably applied to the filaments during the early stages fo processing and before the band of tow is crimped. This may be done conveniently by passing the filaments through an aqueous emulsion of a relatively low molecular weight, curable liquid silicone prior to the step of crimping the filaments and, in the case of materials which, like polyethylene terephthalate, are preferably drawn to develop desirable tenacity and resistance to elongation, prior to the drawing operation.

A suitable silicone is readily made, for example, from the hydrolysis of a major proportion of an alkali dichlorohydrogen silane and a minor portion of a dialkyl dichlorosilane. If desired, there may also be incorporated a small amount of trialkyl chlorosilane, as a chain terminator, and a small amount of alkyl trichlorosilane to promote preliminary cross linking. All of the alkyl groups are preferably lower alkyl, particularly methyl groups. The use of these starting reactants results in a relatively fluid silicone containing a major proportion of methylhydrogenpolysiloxane and a minor proportion of dimethylpolysiloxane.

The polymeric silicone, after it has been emulsified and the emulsion applied to a filamentary material, is then preferably catalytically oxidized or cured so that the silane hydrogens are converted to additional siloxanes oxygen bridges to further cross link the silicone. The resulting cross linked polymeric product is tough, hydrophobic and highly lubricating, forming a flexible film around the surface of each filament.

It is convenient to first emulsify the silicone so as to form an aqueous emulsion of paste-like consistency. Any of the conventional silicone emulsifying agents, e.g., trimethylnonyl ether, can be used. The average particle size of the silicone polymer in this paste emulsion is generally from about 1 to 8 microns, and typically is about 5 microns. This paste is then incorporated into the finishing bath, along with catalyst. The catalyst compound used to promote further cross-linking of the silicone is of the conventional type used for silicone curing and generally is an organometallo compound or mixture thereof, and is typically an organometallo salt. Generally the metal portion of such catalyst compound is zinc, tin, aluminum, zirconium, or the like. Suitable catalysts include zinc acetate, aluminum octoate, organic titanates, and mixtures thereof. As stated previously, such catalyst promotes oxidation of the silane hydrogens to produce additional siloxane oxygen linkages and thereby promote further cross-linking of the silicone polymer.

Generally the catalyst is maintained separately from the silicone emulsion until the finishing bath is to be prepared, and desirably is added as the last component to the finishing bath.

Desirably the weight ratio of silicone to metal catalyst is from about 8:1 to about 1:1. A more preferred range is from about 5:1 to about 3:1. The aqueous composition applied to the filaments may contain, for example, 1 to 5 percent of the silicone.

The proportion of silicone on the filaments is advantageously 0.1 to about 1.0 percent, preferably in the range of about 0.2 to 0.5 percent, based on the weight of the filaments.

The crimping of the filaments carrying the silicone finish is advantageously carried out in a stuffer box crimper in which the tow is forced into a narrow confined zone, thus folding the filaments back and forth on themselves in their passage through said zone. The tow in the crimper may carry a wet film of the aqueous uncured silicone finishing composition, which may be subsequently cured by heat treatment of the crimped tow while the latter is maintained in a relaxed condition, e.g., at a temperature above 100°centigrade, for example 130° to 180° centigrade. Alternatively, curing of the silicone may be effected prior to crimping, as by passing the filaments carrying the uncured silicone finish through a heated drawing zone.

The tow of the present invention is a synthetic polymer such as polyester, that is polyethylene terephthalate, a copolyester such as 70/30 isophthalate and terephthalate, polyesters of other glycols such as dimethylol cyclohexane, cellulose acetate, cellulose triacetate, linear super polyamides such as nylon 6 and nylon 66, polyacrylonitrile and copolymers of acrylonitrile, olefinic polymers and copolymers such as isotactic polypropylene and the like synthetic fibers.

In the production of the product of this invention, tow having crimps in registry, treated with the described silicone material and, being substantially free of antistatic agents, is fed to a crimp deregistration and opening means such as that described in the aforementioned U.S. Pat. Nos. 3,032,829 and 3,156,016 or the like patterned roll tow opening devices. In passing through the tow opening device, the filaments are subjected to the action of the patterned rolls which grip and release the filaments differentially, preferably by action on certain spaced groups of filaments in such a manner that there is a continual change in the selection of the particular filaments making up these spaced groups during passage of the tow between the rolls. Thus, different filaments are gripped and released at different times.

In a most preferred embodiment, a static electrical charge is induced and/or increased on the fibers being processed, preferably in a manner such as that described in the aforementioned parent application, Ser. No. 382,018, filed July 13, 1964, now U.S. Pat. No. 3,328,850.

On completion of the pass through the deregistration zone, the tow is subjected to at least one spreading step, such as that effected by a banding jet, which spreads the tow laterally several fold without effecting any significant further deregistration of the crimps. The banding jets normally comprise two generally parallel walls between which the tow is passed. The tow on passing through the confining walls is subjected to one or more streams or jets of air issuing from one or more slots in the walls. The spreading action can be repeated in stages so as to further increase the width of the tow in each successive stage. Preferably, the spreading of the tow increases its width at least twice and more preferably 2.5 to 10 times its original width on feeding to the deregistration zone.

Following the spreading and preferably prior to additional stages of work, the tow is preferably passed through a deionization stage such as a static elminator to remove static.

In addition to the described air spreading, various mechanical spreaders and other known spreading means can be used.

The number of filaments of the starting tow can vary within wide limits and may range up to as high as 1,000,000 or more with a denier per filament between about 0.5 and 25 and more preferably 1 to 20. The number of crimps per inch of tow can also vary up to about 80 but more preferably about 3 to 50 and most preferably about 3 to 20 crimps per inch of starting tow are sufficient.

The following examples illustrate certain preferred embodiments of the present invention. Unless otherwise indicated, all parts and percentages used therein are by weight.

EXAMPLE 1

A tow having a total denier of 100,000 comprising 5 denier filaments of cellulose acetate was passed through aa bath containing (A) 1.5 percent silicone resin emulsion comprised of a polysiloxane resin containing a major proportion of methylhydrogenpolysiloxane and a minor proportion of dimethylpolysiloxane. The siloxanes were emulsified with an emulsifying agent comprising a mixture of about 70 percent trimethylnonylether and 30 percent silicone; (B) 0.3 percent of a catalyst comprising a mixture of zinc acetate and organic titanate; and (C) the balance being water. The filaments were immersed in the treating bath for about 0.6 to 1.8 seconds at a temperature of 20° to 802 centigrade. The filaments were then passed through a stuffing box crimper maintained at a temperature of about 110° centigrade. After a residence time of about 1.5 minutes, the crimped filaments were discharged and conveyed to an oven dryer at a temperature of about 150° centigrade where, in about 12 minutes, residual water was removed and the silicone cured. The resulting tow had about 12 crimps per inch and carried about 0.25 percent of a cured silicone coating.

The prepared tow was then passed through a pair of patterned rolls in the manner described in the aforementioned parent application, which rolls subjected the individual filaments of the tow to a differential gripping and releasing action, thereby opening and deregistering the crimped tow. After passing through the patterned rolls, the deregistered tow was passed through a banding jet air spreader wherein the tow was spread from an original width of about 8 inches to a width of about 24 inches. By using a second air spreader, a width of 50 inches or more was obtained. During the tow opening and spreading steps, the presence of static electricity was noted in the processing fibers, the presence of which appeared to further enhance the spreading of the tow. Both the deregistered tow and the spread deregistered tow were found to be extremely bulky, resilient and supple in hand.

In the same manner, polyester tow is processed as in Example 1 to produce a deregistered and spread tow having similar characteristics of bulkiness, resiliency and suppleness to the hand.

EXAMPLE 2

A polyester terephthalate tow of 5 denier per filament treated with silicone, deregistered and spread to a width of 50 inches in accordance with Example 1, was made into cushioning products including pillows, furniture batting, sleeping bags, mattress pads and the like, by cross-lapping the spread tow to place the spread filaments one on top of the other thereby increasing the thickness of the spread tow to that desired for the particular end use. For the production of sleeping pillows, the cross lapping was effected to a produce a total thickness of about 1 to 7 inches. The lapped material was then cut into pillow sized sections of about 24 ounces each and subsequently placed in a fabric pillow case.

Comparative tests were then conducted to determine the softness and load supporting properties of the continuous filament pillows versus pillows of similar 5 denier per filament (dpf) polyester staple, Table I gives the average results obtained.

TABLE I

| LOAD SUPPORT VALUES | | |
|---|---|---|
| Property | 5 dpf Polyester Staple | 5 dpf Polyester Silicone Treated Continuous Filament |
| Weight | 1.5 lbs | 1.5 lbs |
| Crown | 6.481-in. | 6.888-in. |
| Load to Compress | | |
| 10% | 1.6 lbs | 1.4 lbs |
| 25% | 4.0 lbs | 4.0 lbs |
| 50% | 10.0 lbs | 12.4 lbs |
| 75% | 32.2 lbs | 38.0 lbs |

As will be noted from the results shown in Table I, the silicone treated continuous filament had greater loft, as measured by the crown and was initially softer with ultimately more load supporting values at the higher compressions. These characteristics more closely resemble goose down which has previously been considered to be a most desirable cushioning material. However, cushioning products made in accordance with the present invention have the further characteristic of being much more resilient than down as illustrated by substantially full recovery after compression.

In the same manner, sleeping bags were produced by cross laying the spread filaments to a thickness of about 2 to 3 inches prior to being cut into the desired size and shape suitable for the particular sleeping bag. The cut filament was then enclosed by fabric sheeting to form a sleeping bag.

In the same manner, mattress pads, furniture batting and cushions were also produced. The resulting cushioning products were found to retain their bulkiness, resiliency and like characteristics even after repeated washings and end usage without the previously encountered balling, matting and the like undesirable characteristics of previous filamentary cushioning materials.

While there have been described various embodiments of the present invention, the process products specifically described are not intended to be understood as limiting the scope of the invention as it is realized that changes therein are possible. It is intended that each element recited in any of the following claims is to be understood as referring to all equivalent elements for accomplishing substantially the same results in substantially the same or equivalent manner. It is intended to cover the invention broadly in whatever form its principles may be utilized.

What is claimed is:

1. A crimped deregistered tow of continuous filaments wherein said filaments are coated with a silicone finish consisting essentially of a free of an antistatic agent.

2. The product of claim 1 wherein the tow is comprised of cellulose acetate filaments.

3. The product of claim 1 wherein the tow is comprised of polyester filaments.

4. The product of claim 1 wherein the individual filaments of the tow are coated with about 0.1 to 1 percent of a hydrophobic silicone.

5. The product of claim 1 wherein the tow is spread to at least twice its original width after deregistration.

6. The product of claim 5 wherein the tow is spread about 2.5 to about 10 times its original width after the deregistration.

7. The product of claim 1 wherein the tow is spread to a width of 2.5 to about 10 times its original width after deregistration and is in the form of a cushioning product.

8. The product of claim 7 wherein the cushioning product is a pillow.

9. The product of claim 7 wherein the cushioning product is a sleeping bag.

10. The product of claim 7 wherein the cushioning product is a mattress pad.

11. The product of claim 1 wherein the tow of continuous filaments is coated with about 0.1 to 1 percent of a hydrophobic lower alkyl polysiloxane, said tow initially containing about 3 to 50 crimps per inch and being of a denier per filament in the range of about 0.5 to 25, said deregistered tow being spread to a width of about 2 to 10 times its original width prior to deregistration.

12. The product of claim 11 wherein the tow is comprised of polyester filaments.

13. The product of claim 11 wherein the tow is comprised of cellulose acetate filaments.

14. The product of claim 11 wherein the tow is coated with about 0.2 to 0.5 per cent of a hydrophobic lower alkyl polysiloxane.

15. The product of claim 11 wherein the hydrophobic lower alkyl polysiloxane comprises a major proportion of methyl hydrogen polysiloxane and a minor proportion of dimethyl polysiloxane.

* * * * *

PO-1050
(5/69)

UNITED STATES PATENT OFFICE
CERTIFICATE OF CORRECTION

Patent No. 3,952,134 Dated April 20, 1976

Inventor(s) George A. Watson

It is certified that error appears in the above-identified patent and that said Letters Patent are hereby corrected as shown below:

Column 2, line 27, "fo" should read -- of --.

Column 4, line 36, "aa" should read -- a --.

Column 4, line 47, "802" should read -- $80^{o}$ --.

Column 5, line 22, before the word "produce", the word "a" should be omitted.

Claim 1, line 2, the word "silicone" should be omitted.

Claim 1, line 3, after "a", the word -- silicone -- should be inserted.

Signed and Sealed this

Fourteenth Day of December 1976

[SEAL]

*Attest:*

RUTH C. MASON
*Attesting Officer*

C. MARSHALL DANN
*Commissioner of Patents and Trademarks*